United States Patent [19]

Nakahata et al.

[11] Patent Number: 4,484,811

[45] Date of Patent: Nov. 27, 1984

[54] APPARATUS FOR FORMING AN IMAGE ON A RECORDING MEMBER

[75] Inventors: Kimio Nakahata, Kawasaki; Hatsuo Tajima, Matsudo; Naoki Iwami; Shunichi Masuda, both of Tokyo; Katsuichi Shimizu, Hoya; Yoshihiro Kawatsura, Kawasaki; Koji Suzuki, Yokohama; Yoshikazu Yokomizo, Kawagoe, all of Japan

[73] Assignee: Canon Kabushiki Kaisha, Tokyo, Japan

[21] Appl. No.: 329,018

[22] Filed: Dec. 9, 1981

Related U.S. Application Data

[62] Division of Ser. No. 83,773, Oct. 11, 1979.

[30] Foreign Application Priority Data

Oct. 14, 1978 [JP] Japan ..... 53-126735
Oct. 14, 1978 [JP] Japan ..... 53-126737
Oct. 14, 1978 [JP] Japan ..... 53-126740

[51] Int. Cl.[3] ..... G03G 15/00

[52] U.S. Cl. ..... 355/14 CH; 355/14 E; 355/14 R

[58] Field of Search ..... 355/14 E, 14 CH, 14 R, 355/14 C, 3 R

[56] References Cited

U.S. PATENT DOCUMENTS 3,788,739 1/1974 Coriale ..... 355/14 E
3,944,354 3/1976 Benwood et al. ..... 355/3 R
3,998,538 12/1976 Urso et al. ..... 355/14 D
4,019,102 4/1977 Wallot ..... 355/14 CH
4,063,154 12/1977 Andrus et al. ..... 355/14 R
4,206,995 6/1980 Legg ..... 355/14 C

*Primary Examiner*—R. L. Moses

*Attorney, Agent, or Firm*—Fitzpatrick, Cella, Harper & Scinto

[57] ABSTRACT

The image forming method is executed by projecting a light image on a rotatable recording member to consecutively form electrostatic latent images corresponding to the light image, developing the latent images, projecting a predetermined amount of light onto a non-imaged area present between two consecutive latent images on the recording member to form an electrostatic image, detecting potential of the electrostatic image, and controlling the development of the latent images next to the electrostatic image detected during the detection of the potential in response to the detection results. This method is performed in the image forming apparatus which includes a rotatable recording member, processing units for projecting a light image onto the recording member to consecutively form electrostatic latent images corresponding to the light image, a developer unit for developing the latent images, a voltage applying circuit for applying a voltage to the developer unit, a projecting unit for projecting a predetermined amount of light onto a non-imaged area present between two consecutive latent images on the recording member, a detector for detecting surface potential of the non-imaged area, and a controller for controlling the voltage applying circuit in response to detection output from the detector in the development of the latent image next to the non-imaged area in the developer unit.

22 Claims, 29 Drawing Figures

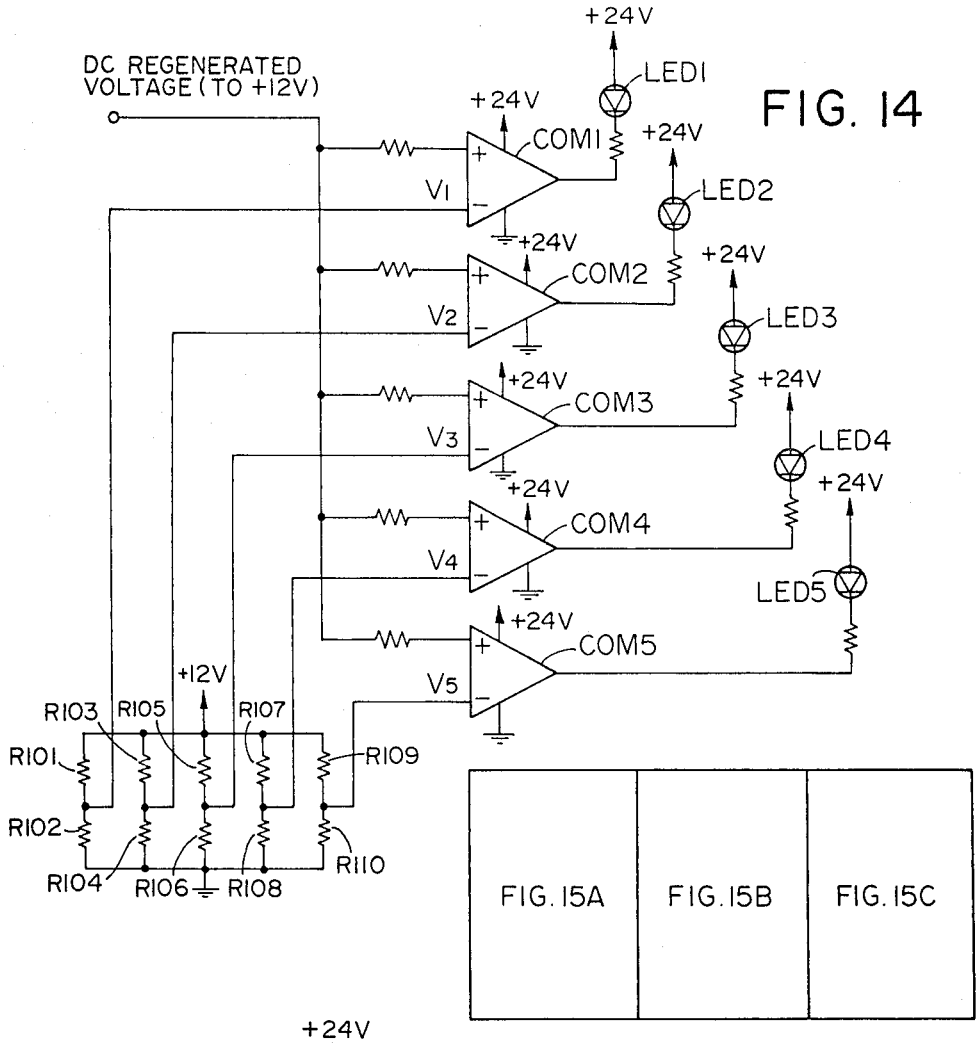
FIG. 14
FIG. 15
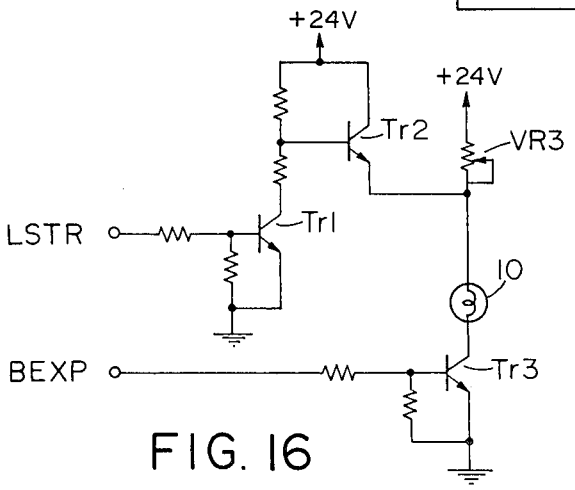
FIG. 16

APPARATUS FOR FORMING AN IMAGE ON A RECORDING MEMBER

This is a divisional of application Ser. No. 83,773 filed Oct. 11, 1979.

BACKGROUND OF THE INVENTION

1. Field of the Invention

The present invention relates to an image forming process and apparatus therefor wherein surface potential of a recording member is sensed and image formation is controlled in response to output of the potential sensing.

2. Description of the Prior Art

In a conventional image forming apparatus for obtaining a visible image by forming an electrostatic latent image on a recording member and developing the latent image, it has been difficult to achieve stable image formation due to fluctuation of static potential on the recording member caused by an unstable output of the charger for latent image formation resulting from eventual variation in circumferential factors such as temperature and moisture. Also in consecutive latent image formations on a photosensitive member, photosensitive characteristics thereof in an image formation cycle are affected by the preceding image formation cycle. This is due to the fact that the photosensitive member has a certain memory property which is dependent on the conditions of preparation thereof, so that in consecutive image formation there inevitably appears a certain fluctuation in surface potential even if a constant exposure is given to the photosensitive member.

In an image forming apparatus utilizing an electrophotographic process comprising the steps of charging, exposure, development and image transfer, a non-imaged area not exposed to the imaging light is generated subjected to charge elimination, by exposure to a lamp generally called a blank exposure lamp, in order to prevent eventual development of the non-imaged area.

It was therefore considered to expose a non-imaged area of the photosensitive member to a determined amount of light of the blank exposure lamp and to control the charger or the developing bias according to the surface potential measured on the thus exposed area. In such a case, however, it is to be noted that the measurement of surface potential generated by the blank exposure lamp becomes meaningless in case the amount of light exceeds a certain determined level as the photosensitive member becomes saturated as shown in FIG. 8.

For this reason the amount of blank exposure for the measurement should be located within so-called dynamic range wherein the potential varies according to the amount of light. Stated differently the blank exposure lamp should provide a somewhat smaller amount of light, which will be called a weak blank exposure. The charge elimination conducted with such weak blank exposure will leave an uneven electric field due to carriers (electrons and holes) generated in the photosensitive layer. If left standing in this state, the carriers shift to metastable state, thus forming electron traps or hole traps and resulting in an uneven electric field. In the case of a 3-layered photosensitive member composed of an insulating layer, a photoconductive layer and a metal layer in succession from the surface thereof, the uneven electric field inside the photosensitive layer can be eliminated if the photosensitive member is subjected to overall or whole surface light exposure after charge elimination since the photoconductive layer is rendered conductive. However the surface charge is dissipated spontaneously or by contact with the developing brush or the cleaning blade after prolonged standing, whereby an uneven electric field is formed within the photosensitive layer to undesirably affect the succeeding latent image formation.

Also the charger output, developing bias voltage, exposure lamp power etc. have been regulated by servicemen on the basis of measurement of the surface potential on the recording member. In such measurement, the servicemen are required to memorize plural data on light and dark potentials of a latent image formed on the recording member, and such operation has been extremely tedious for them.

Furthermore, in a conventional image forming apparatus such as a copier, the function of the apparatus can only be verified by the drive of the entire apparatus, and it has not been possible to inspect the function of each component.

SUMMARY OF THE INVENTION

An object of the present invention is to provide an image forming process and apparatus therefor which are not associated with the above-mentioned drawbacks of the prior technology.

More specifically, an object of the present invention is to provide an image forming process and apparatus therefor wherein, in consecutive latent image forming cycles, a non-imaged area present between two consecutive latent images is exposed to a predetermined amount of light to form an electrostatic image, of which potential is measured to control the development of the latent image following the electrostatic image.

Another object of the present invention is to provide an electrophotographic image forming apparatus wherein the amount of light from the blank exposure lamp is regulated to a predetermined value at the measurement of surface potential of an area exposed to the lamp and is regulated to a value larger than the predetermined value after a completion of the measurement.

Still another object of the present invention is to provide an image forming apparatus wherein surface potentials of different modes on the recording member can be adjusted to respectively different target values, utilizing approximately the same output voltages appearing on detecting means.

Still another object of the present invention is to provide an image forming apparatus capable of selectively driving a part of processing means for image formation.

BRIEF DESCRIPTION OF THE DRAWINGS

FIG. 7-1 is a waveform chart showing the output from the surface potential sensor;

FIG. 7-2 is a chart showing the relationship between the drum potential $V_p$ and the peak value of the preamplifier output 62 as a function of sensor bias $V_{BIAS}$;

FIG. 14 is a comparator-display circuit diagram;

FIG. 16 is a schematic circuit diagram for switching the amount of light from the blank exposure lamp.

DESCRIPTION OF THE PREFERRED EMBODIMENTS

Figure 1:
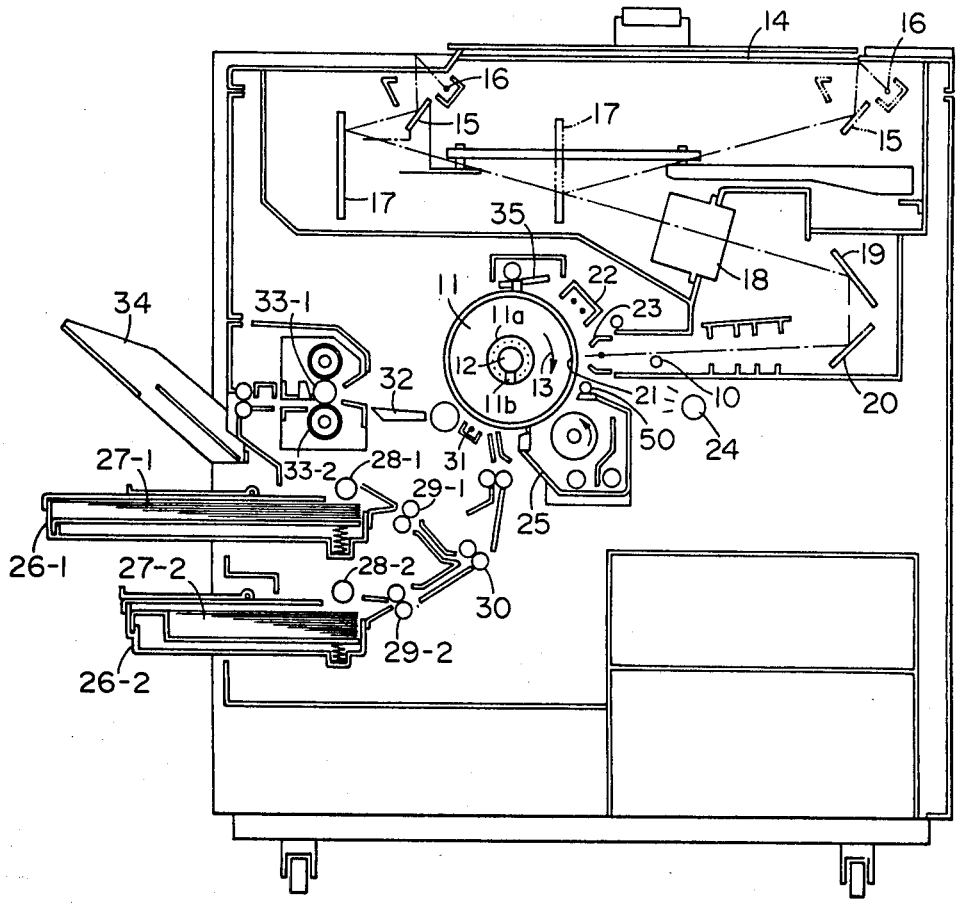
FIG. 1 is a cross-sectional view of a copier to which the present invention is applicable.

Referring to FIG. 1 showing, in a cross-sectional view, a copier to which the present invention is applicable, and in which a drum 11 provided on the surface thereof with a 3-layered photosensitive member composed of a transparent insulating layer, a CdS photoconductive layer and a electro-conductive layer in succession from the outer surface thereof is rotatably supported on a shaft 12 and is adapted to initiate rotation in the direction of arrow 13 in response to a copy instruction.

Upon arrival of the drum 11 at a predetermined position, an original document placed on an original support glass 14 is illuminated by an illuminating lamp 16 integrally structured with a first scanning mirror 15, and the light reflected by the original is swept by the first scanning mirror 15 and a second scanning mirror 17. Those mirrors are displaced at a speed ratio of 1:½ thereby maintaining constant the optical path length in front of a lens system 18 during the scanning.

The above-mentioned light beam is transmitted through lens 18, a third mirror 19 and a fourth mirror 20 and focused on the drum 11 in an exposure station 21.

The drum 11, charged, for example positively in advance by a primary charger 22, is subjected, in exposure station 21, to a slit exposure of the image of the original illuminated by illuminating lamp 16.

Simultaneously the drum is subjected to an AC charge elimination or a charge elimination of a polarity (for example negative) opposite to that of the primary charging by means of a charge eliminator 23, and thereafter to a flush exposure by a whole surface exposure lamp 24 thereby forming an electrostatic latent image of an elevated contrast on drum 11. The latent image is subsequently rendered visible as a toner image in a developing station 25. Such image development may be achieved for example by liquid development or magnetic brush development, of which the latter is employed in the illustrated embodiment.

A transfer sheet 27-1 or 27-2 stored in a cassette 26-1 or 26-2 is supplied into the apparatus by a feed roller 28-1 or 28-2 and advanced toward the photosensitive drum 11 wherein a first registration roller 29-1 or 29-2 and a second registration roller 30 effect the approximate and exact timing, respectively, for such advancement.

The toner image present on the drum 11 is transferred onto a transfer sheet 27 during the time the sheet passes between a transfer charger 31 and the drum 11.

Upon completion of the image transfer, the transfer sheet is guided onto a conveyor belt 32 and further to a pair of fixing rollers 33-1 and 33-2 wherein the image is fixed by heating and pressure, and the sheet is thereafter ejected onto a tray 34.

The drum 11, after the image transfer, is subjected to surface cleaning by a cleaning station 35 composed of an elastic blade, thus being prepared for the succeeding cycle.

In order to control the steps of the above-explained image forming cycle, there are obtained drum clock pulses DCK by a clock disc 11*a* rotating integrally with drum 11 and a sensor 11*b* for optically detecting the clock dots provided on the disc.

Numeral 50 denotes a surface potential sensor mounted on the developing station 21 for detecting the surface potential of the drum 11.

Figure 2:
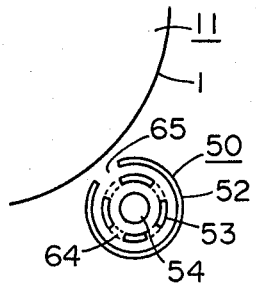
FIG. 2 is a lateral cross-sectional view showing the relationship between the surface potential sensor and the drum.
Figure 3:
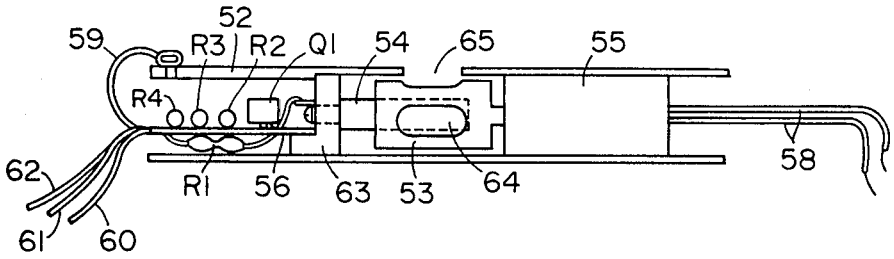
FIG. 3 is a cross-sectional view of the surface potential sensor.
Figure 4:
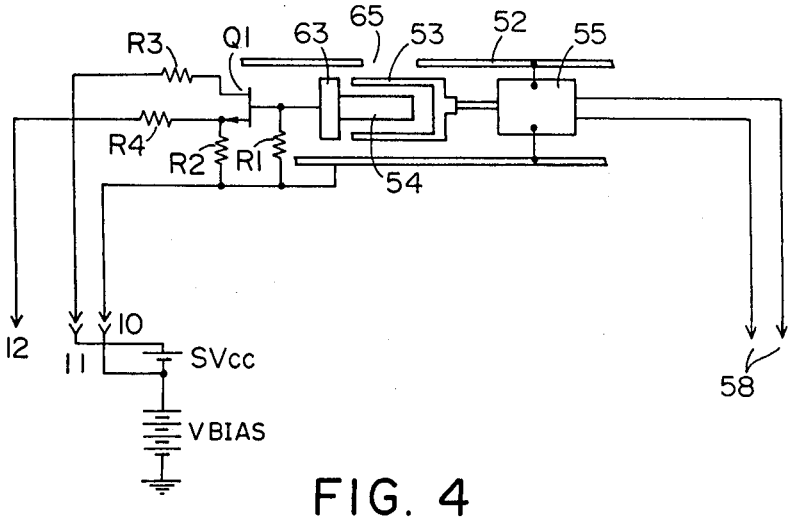
FIG. 4 is a schematic circuit diagram for sensing the surface potential.
Figure 5:
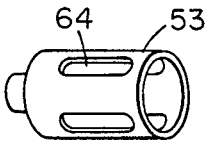
FIG. 5 is a perspective view of a cage-shaped chopper.

Now there will be given an explanation on surface potential sensor 50, while making reference to FIG. 2 showing the positional relationship thereof with the drum 11 in a lateral cross-sectional view, FIG. 3 showing sensor 50 in a cross-sectional view, FIG. 4 showing a surface potential detecting circuit and FIG. 5 showing, in a perspective view, a cage-shaped chopper 53 for shielding the measuring electrode from the surface to be measured.

In FIGS. 2, 3 and 4, there are shown an outer tube 52 made of brass or aluminum and provided with a potential sensing aperture 65, a sensor motor 55 for rotating a tubular chopper 53 provided with measuring apertures 64, a surface potential measuring electrode 54, and a preamplifier circuit board 56 having a detecting circuit for detecting the output of electrode 54.

Sensor 50 is mounted at a distance of 2 mm from the drum surface to be measured in such a manner that measuring aperture 65 faces the drum surface, and sensor 50 incorporates therein the preamplifier circuit board 56 for amplifying the voltage obtained from electrode 54. Upon receipt of a sensor motor drive signal SMD from the CPU 201 in the control circuit shown in FIG. 6, the sensor motor 55 initiates rotation whereby the charge on the drum surface induces a charge on electrode 54 through apertures 63, four of which are provided at regular intervals around chopper 53. Because of the shielding between the drum surface 1 and the electrode 54 at regular intervals by the rotation of chopper 53, there is induced, on electrode 54, an AC voltage as shown in FIG. 7-1, of which interval T follows the expression:

$$T = 1/(\text{revolution of sensor motor} \times 4).$$

Also the amplitude of voltage $V_{p\text{-}p}$ is proportional to the difference between the sensor bias voltage $V_{BIAS}$ which is the standard voltage for the outer tube 52, chopper 53 and preamplifier circuit board 56 and the drum surface potential Vp. Thus amplitude $V_{p\text{-}p}$ becomes zero in case $Vp=V_{BIAS}$. The circuit provided in preamplifier circuit board 56 is driven by a sensor power voltage SVcc overlapped with sensor bias voltage $V_{BIAS}$ and performs the impedance conversion of the AC signal obtained from electrode 54. In the circuit, Q1 designates a junction-type field-effect transistor for converting the weak AC signal induced on electrode 54 received by the high-impedance gate into a signal of low impedance, while R3 and R4 represent resistors for protection.

Figures 1, 7:
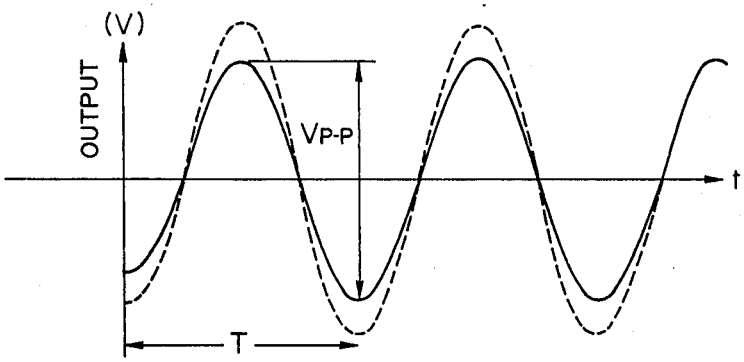
Figures 2, 7:
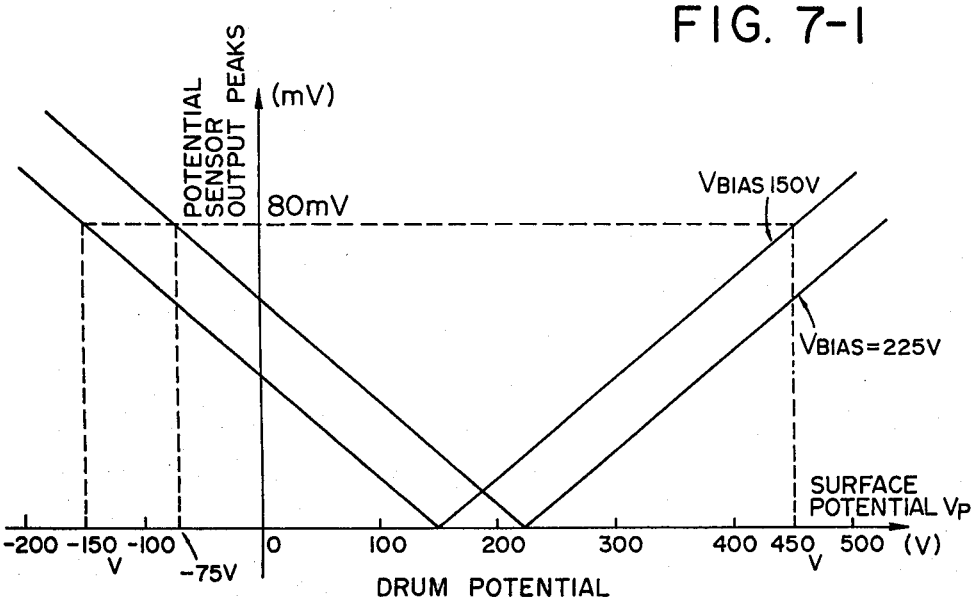

Referring to FIG. 7-2 showing the relationship between the drum surface potential Vp and the peak value of the preamplifier output 62 as a function of the sensor bias $V_{BIAS}$, it will be apparent that output 62 is exactly equal to the difference between the drum surface potential Vp and the sensor bias $V_{BIAS}$. Also, since the AC detection voltage monotonously increases or decreases in response to the drum surface potential Vp, as long as potential Vp changes within a range either of $Vp \geqq V_{BIAS}$ or of $Vp \leqq V_{BIAS}$, a separate synchronized rectifying circuit is not needed for identifying the polarity. For example, in case $V_{BIAS}$ is 150 V, as will be apparent from FIG. 7-2, the detected voltage monotonously increases until the drum surface potential reaches 150 V, whereby it is rendered possible to identify the magnitude of the potential regardless of whether it is positive or negative, though the negative potential detection is naturally limited by the saturation voltage of the circuit provided in the circuit board 56.

As explained in the foregoing it is rendered possible to identify the polarity of the potential of the surface to be measured by applying a predetermined positive or negative bias to the casing of the potential sensor and the circuit incorporated therein in such a manner that the varying range of the potential is located under or above the bias potential. Such structure not only eliminates a separate circuit for polarity detection but also avoids the fluctuation of measured potential resulting from the influence of external noise.

Figure 8:
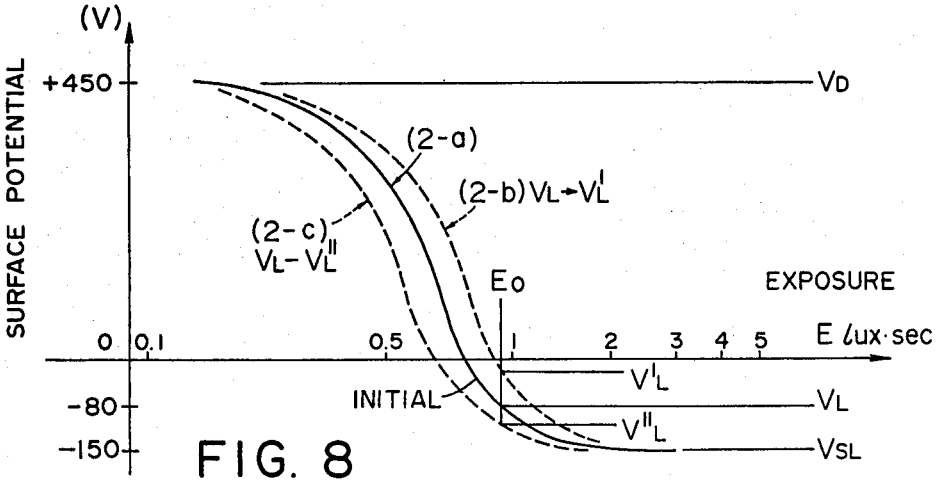
FIG. 8 is a chart showing the photosensitive characteristics of the photosensitive member.

In a copier in which the remaining charge is eliminated by exposing the photosensitive member to light, the photosensitive characteristics of the photosensitive member in a latent image forming cycle are affected by the preceding latent image forming cycle in case copying cycles are consecutively conducted with constant output voltage of primary charger 22, output voltage of charge eliminator 23 and exposure by lamp 16. This is due to the fact that the photosensitive member has a certain memory characteristic which is dependent on the conditions of preparation of the member and which may, as shown in FIG. 8, increase (**2-*c*) or decrease (2-*b*) the sensitivity of the photosensitive member, so that there is observed a variation in the surface potential of the photosensitive member obtained in response to a standard amount of light Eo, which is defined as the amount of light reflected from a standard white original while a light adjusting dial (not shown) is placed at a center position, i.e. position 5**.

Figure 9:
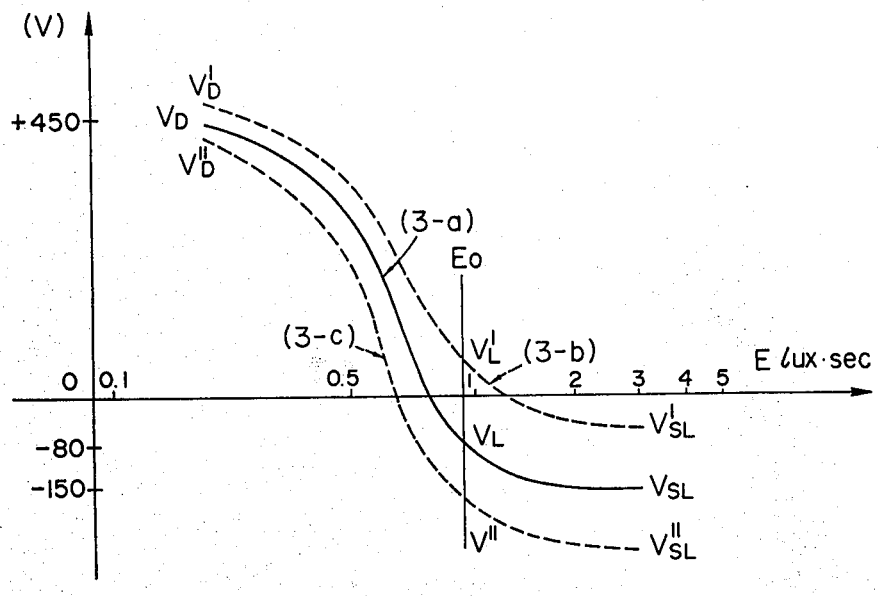
FIG. 9 is a chart showing the changes in the characteristics of the photosensitive member by the circumferential factors.

Also, the changes in the circumferential factors such as temperature and moisture affect particularly the output voltage of the AC charge eliminator 23, giving influence principally in a lighter portion of the original. FIG. 9 shows the characteristics of the photosensitive member affected by the variation in the output voltage of AC charge elimination, wherein the curves (**3-*b*) and (3-*c***) respectively are plotted in the case where the output voltage of the AC charge eliminator becomes lower or higher due to circumferential influence, with corresponding change of light saturation voltage $V_{SL}$ to $V_{SL}'$, or $V_{SL}''$.

In this manner the state of image such as the density of a dark or intermediate area or the fog of a light image area can be affected by the continuous copying operation or by the change in the circumferential conditions, but for the purpose of obtaining a satisfactory copy it is particularly important to reduce the fogging in the light image area.

In the following there will therefore be given an explanation of a control process for controlling the bias voltage of the developing device for reducing the fogging in the light image area.

In the present embodiment the drum surface potential of the light image area is detected by using not the illuminating lamp 16 but the blank exposure lamp 10 which illuminates the drum surface during a pre-rotation thereof and the backward displacement of the optical system. The drum surface potential in this state is measured as representing the surface potential in the light image area, and the developing bias applied to the developing device 25 is regulated according to the thus detected voltage. At this measurement the amount of light which the drum receives from the blank exposure lamp 10 is regulated by a variable resistor VR3 at a value equal to the amount of light of the illuminating lamp 16 reflected from a white original when a control dial (not shown) is placed at a middle position, i.e. position 5. Consequently the drum surface potential sensed in response to the illumination with blank exposure lamp 10 corresponds to the surface potential formed on the drum during the copying operation in response to a white original, and it is rendered possible to prevent fog formation on the copy even in the case of a fluctuation in the potential of the light image area resulting from an eventual variation in the photosensitive characteristics of the drum 11, by adding a positive, determined voltage to the developing bias voltage in response to the detected surface potential.

In the present embodiment the surface potential measurement of the light image area illuminated by the blank exposure lamp 10 is conducted in the non-imaged area during the aforementioned pre-rotation of the drum and in the non-imaged area present between two succeeding electrostatic latent images. The output of such measurement is utilized as a standard for determining the developing bias to be used in the development of a latent image following the non-imaged area.

Figure 6:
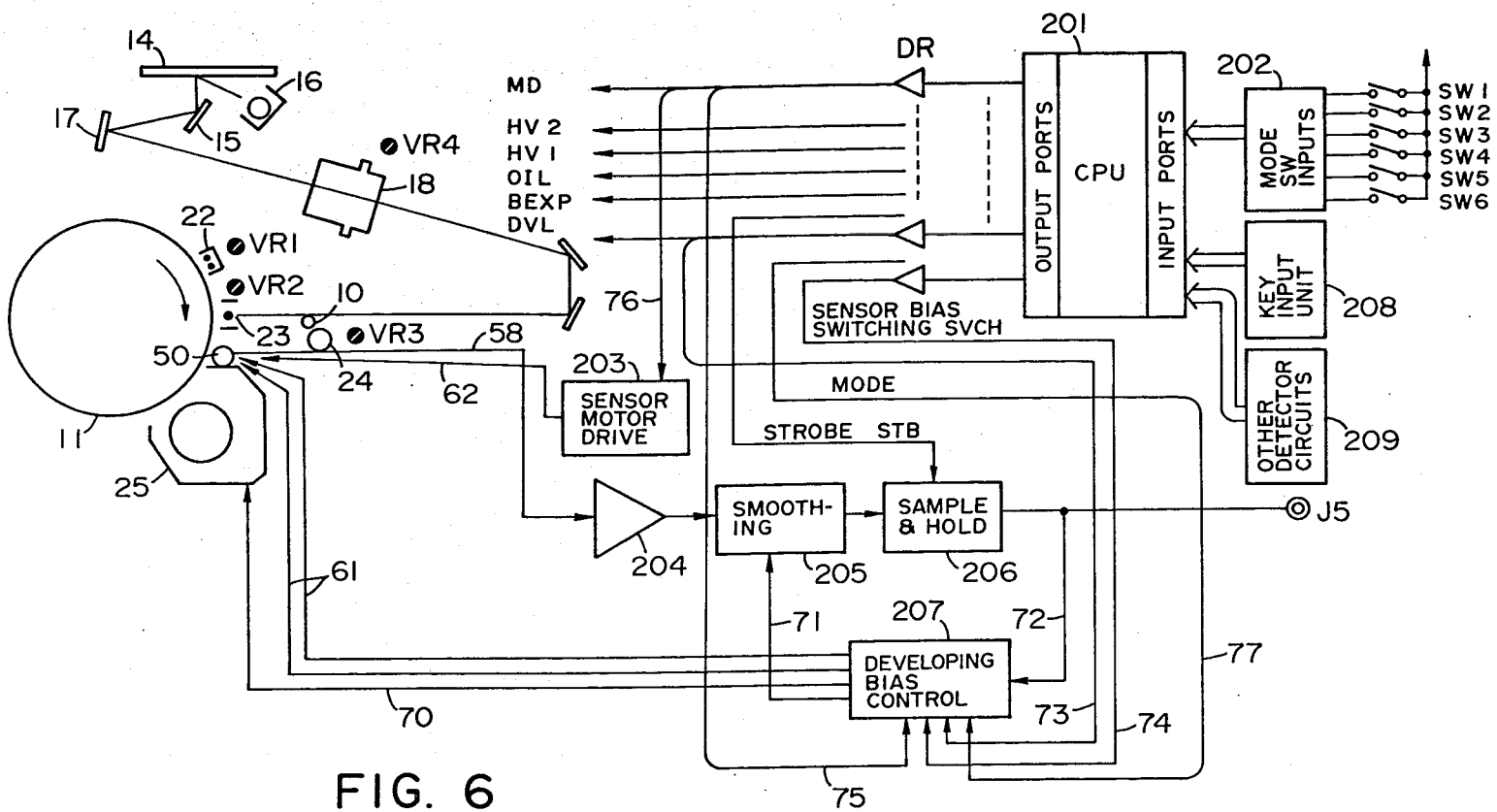
FIG. 6 is schematic diagram showing control circuitry for the copier shown in FIG. 1.
Figure 15A:
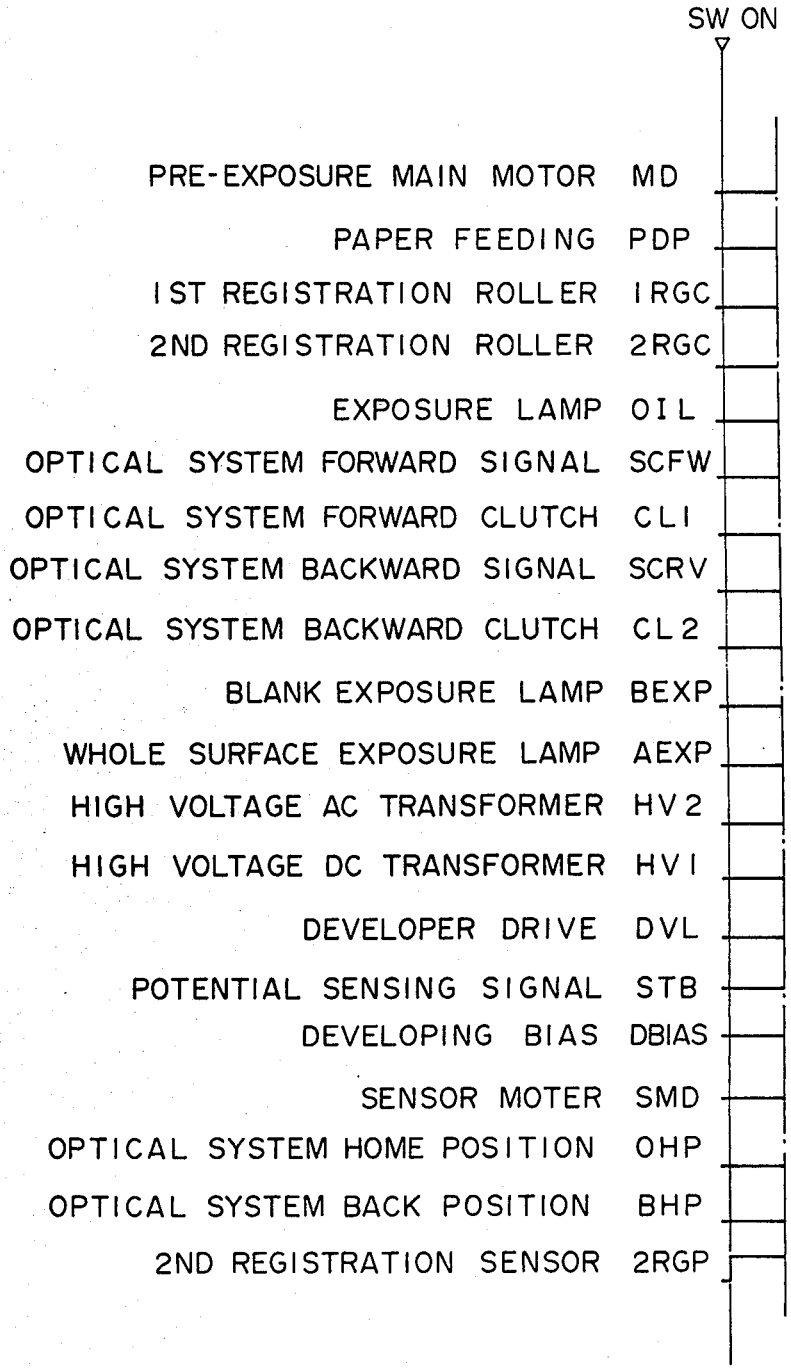
FIGS. 15A–15C, when combined as shown in FIG. 15, are timing charts of the copier shown in FIG. 1.
Figure 15B:
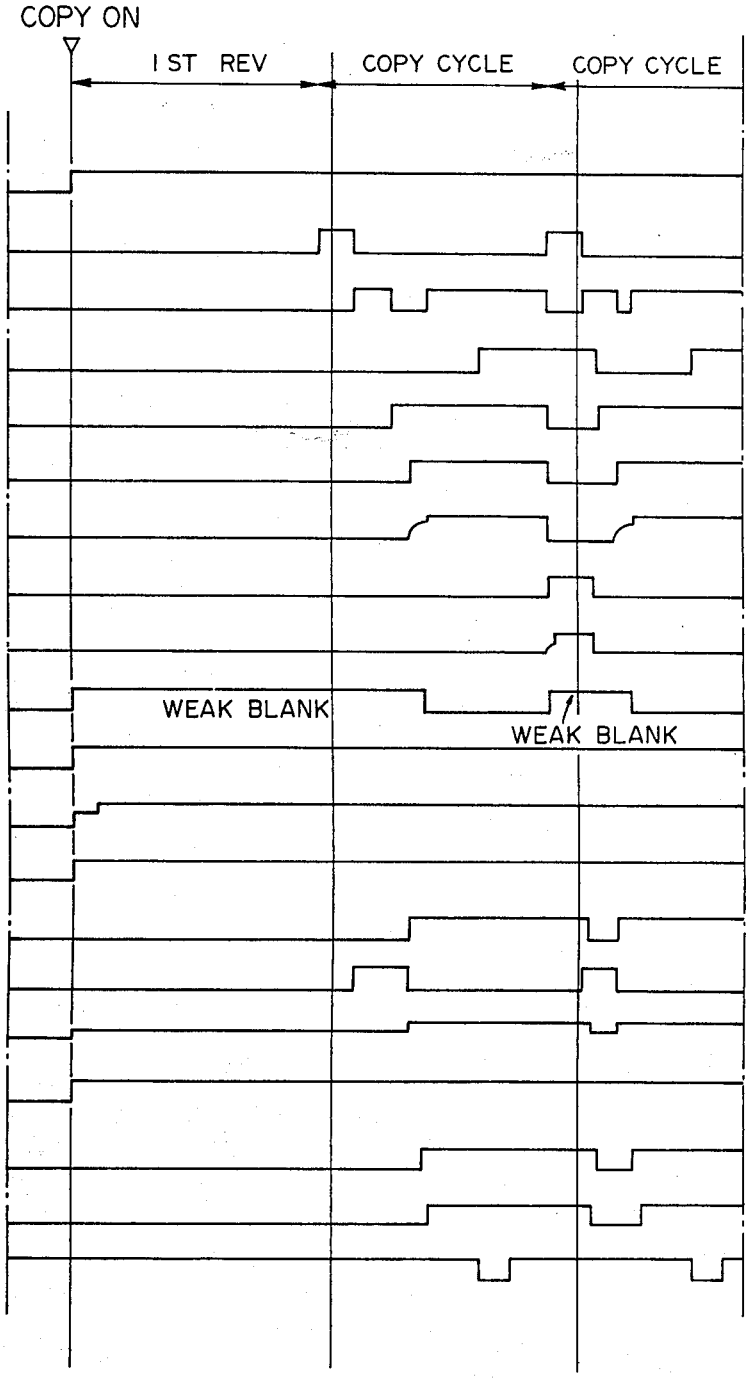
Figure 15C:
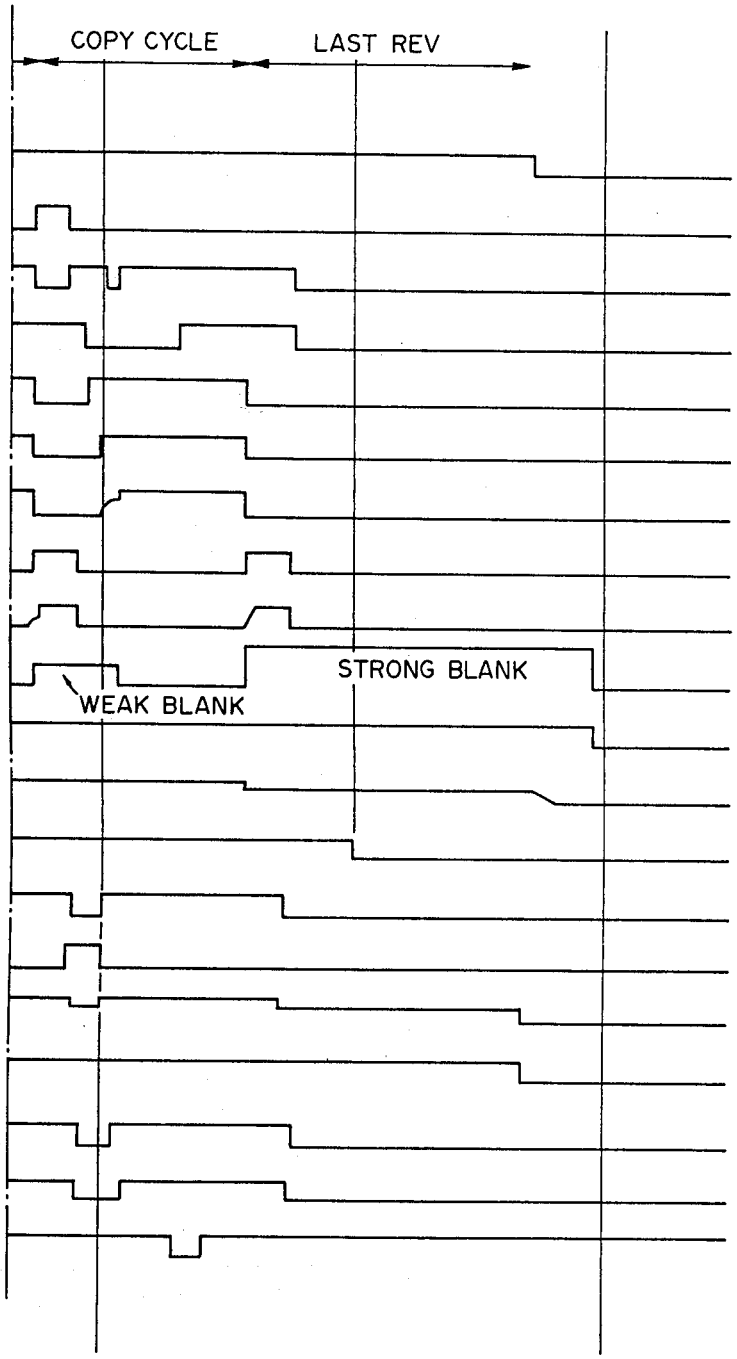
Figure 17A:
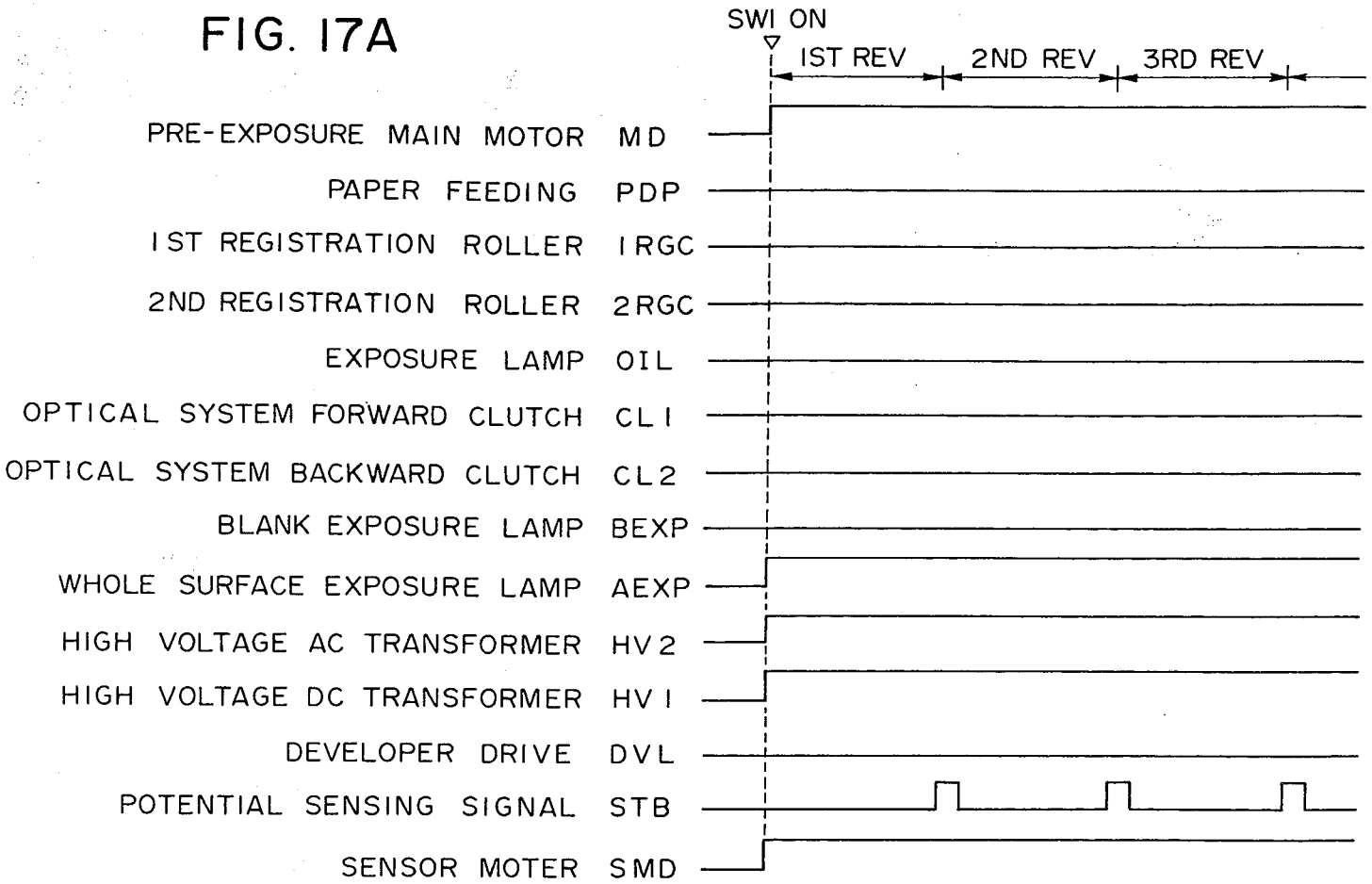
FIGS. 17A–17D are timing charts for various modes of the copier.
Figure 17B:
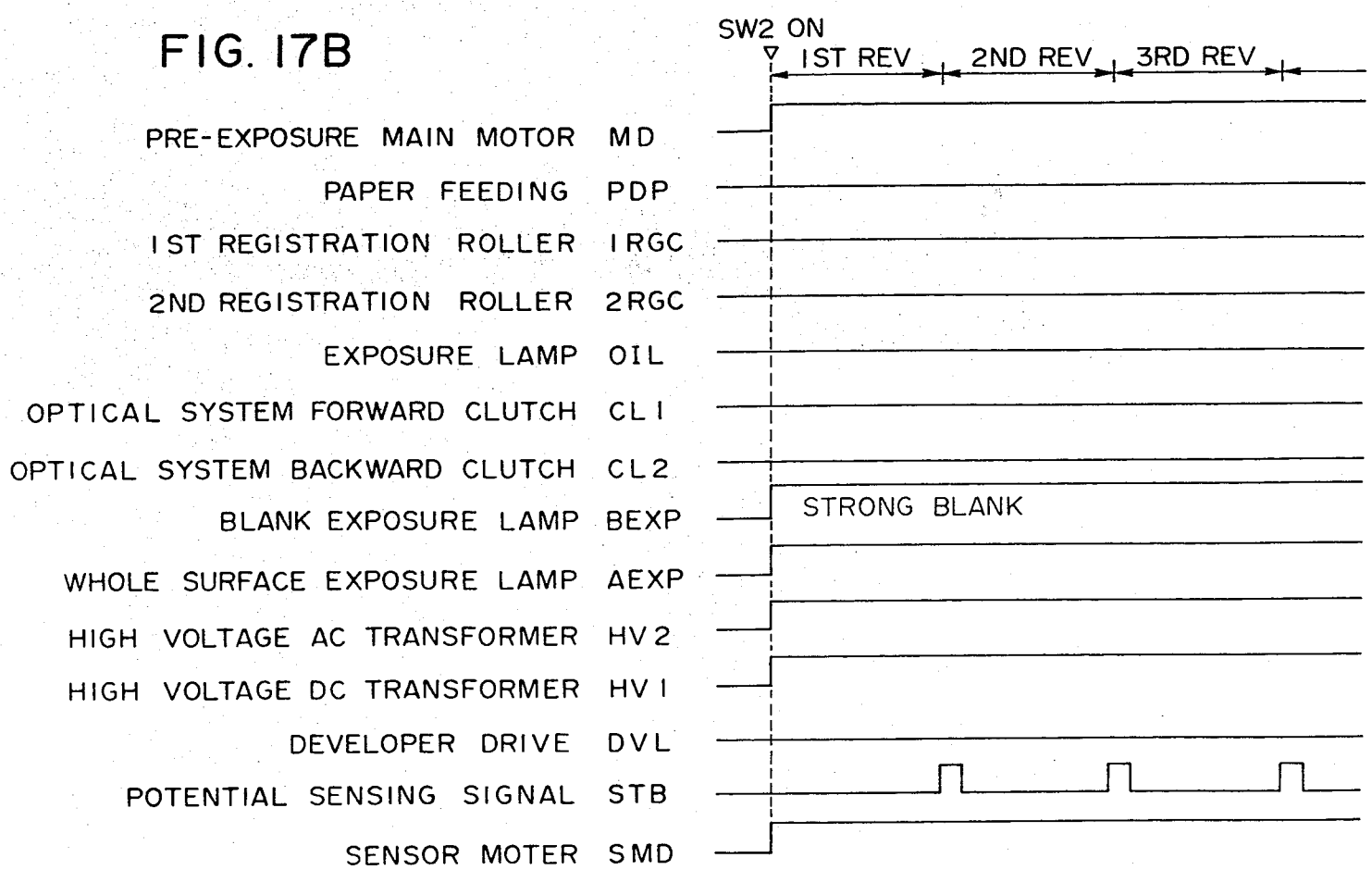
Figure 17C:
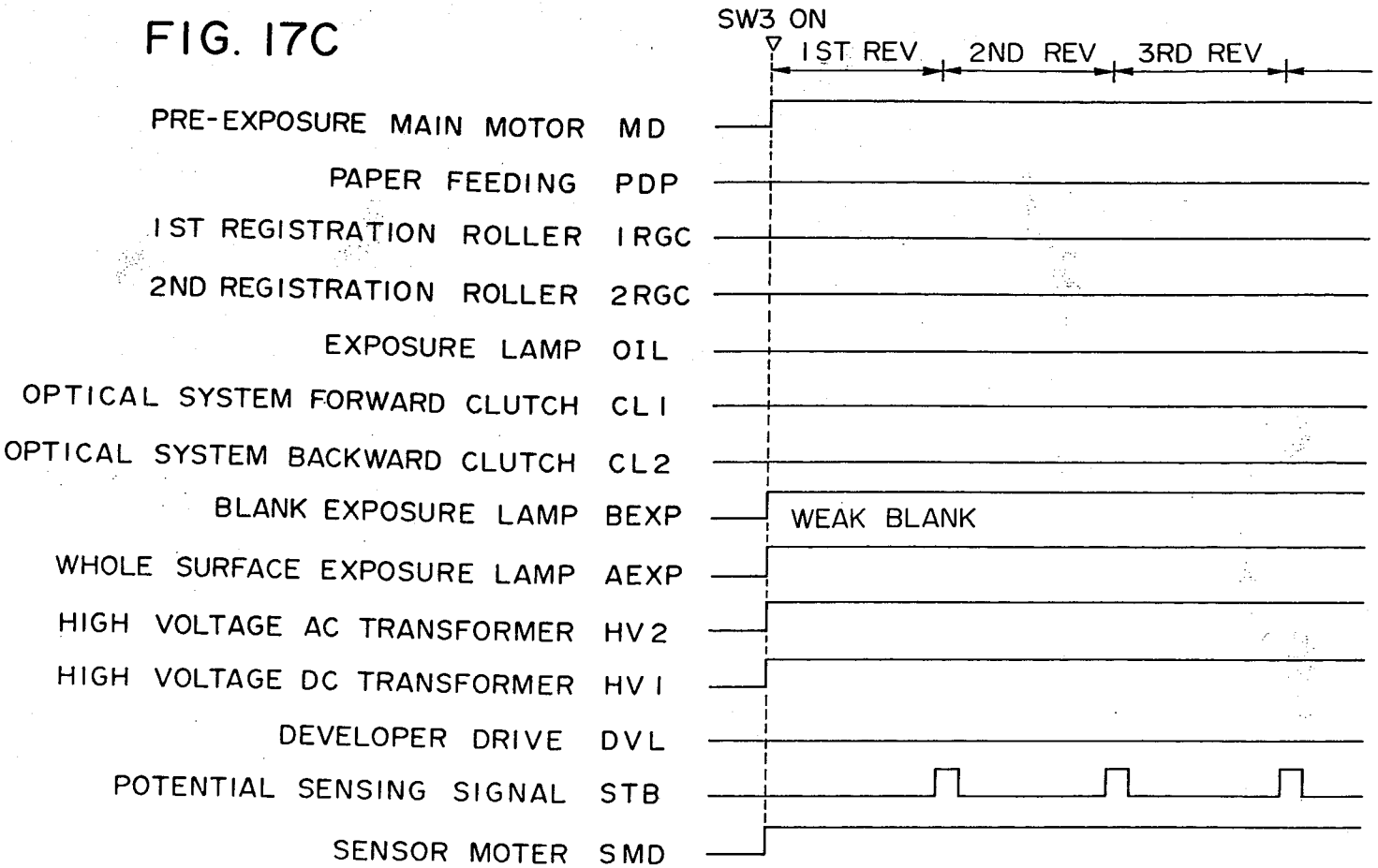
Figure 17D:
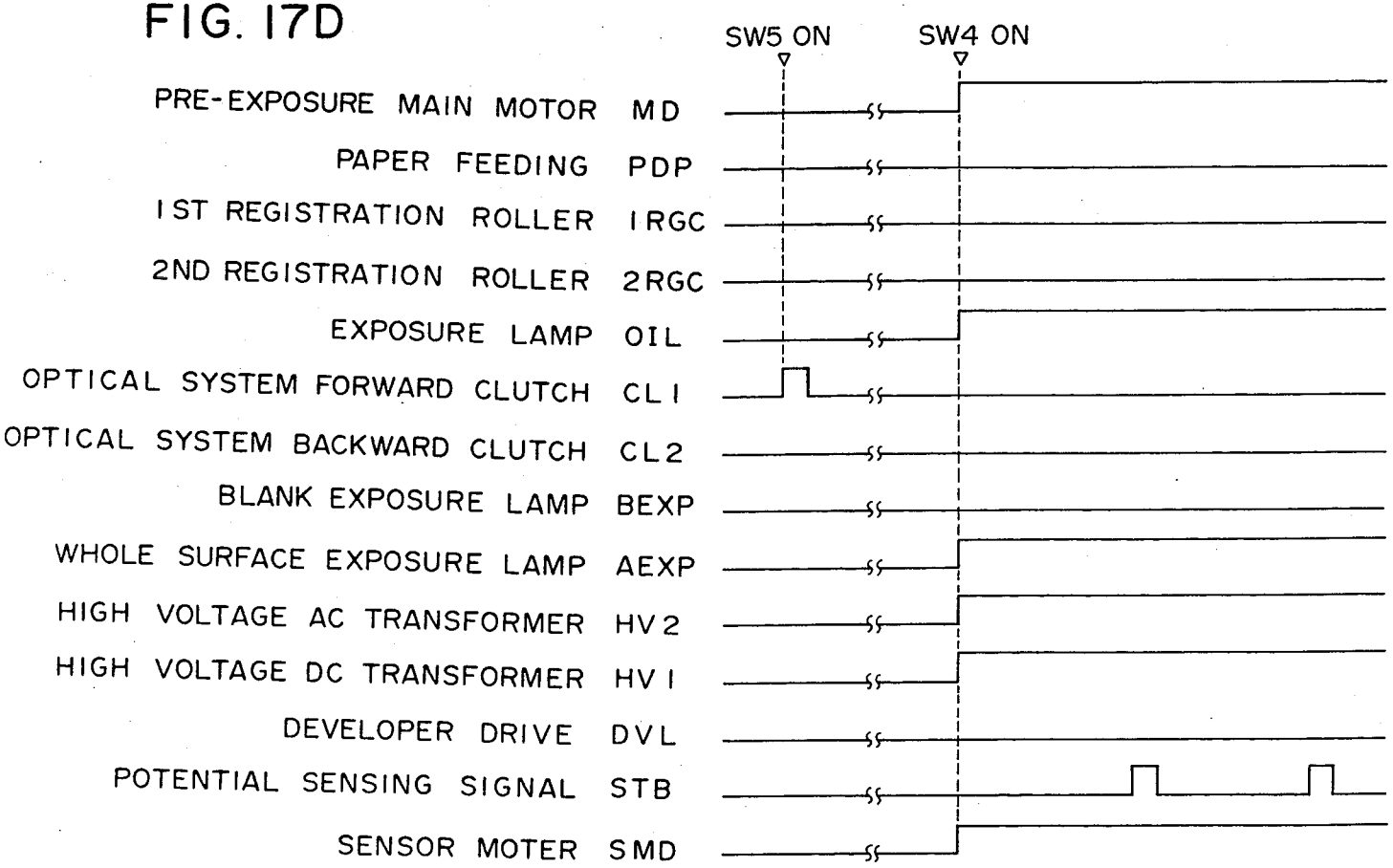

Now referring to FIG. 6 showing the control circuit and FIGS. 15A–15C showing a timing chart thereof, upon receipt of a copy start signal from a key input unit 208, a central processing unit CPU 201 releases a motor drive signal MD to turn on the high-voltage AC charge eliminator 23, high-voltage primary charger 22, whole surface exposure lamp 24, blank exposure lamp 10 and sensor motor 55 and to perform the aforementioned pre-rotation. In this state the sensor motor 55 is driven by a sensor motor drive circuit. The outer tube 52 and chopper 53 of the sensor are supplied with the aforementioned determined sensor bias $V_{BIAS}$ (+150 Volts) while the circuit contained in the preamplifier circuit board 56 is supplied with a determined sensor drive voltage $SV_{cc}$(+175 volts) respectively through lines 60 and 61 from a developing bias control 207.

The AC signal detected by the sensor 50 and supplied through a line 62 is amplified in an AC amplifier 204 and changed into a DC signal by a rectifying-smoothing circuit 205. The DC signal is supplied to a sample and hold circuit 206, in which the value of the signal is held when the signal STB from the CPU 201 is at the high level. Upon completion of the prerotation the exposure lamp 16 is lighted, the optical system composed of the lamp 16 and mirrors 15, 17 initiates scanning motion according to a size of the original and the developing motor is energized to initiate the developing operation. In response to a developer drive signal DVL through a line 74, the developing bias control 207 selects a constant value or the aforementioned DC signal in such a manner that the developing bias corresponding to a measured surface potential of the light image area is applied to the developing unit 25 only when the developing motor is rotated for the development of the latent image.

In the case of a continuous multiple copying, the potential sensing signal STB is developed from the CPU 201 during the backward motion of the optical system in each imaging cycle to light the blank exposure lamp thereby measuring and memorizing the potential of the light image area and thus controlling the developing bias control 207 in the aboveexplained manner. As discussed in the foregoing, the process of the present invention, a feature of which is the exposing of a non-imaged area present between two consecutively formed latent images to a pedetermined amount of light to form an electrostatic image in the non-image area and controlling the development of the latent image present next to the electrostatic image according to the measured potential thereof, allows compensation for fluctuation in the characteristics of the photosensitive member resulting from consecutive imaging cycles and in the output of the charger resulting from the changes in circumferential factors by suitable control of the development, thereby achieving stable image formation and particularly preventing the fog effect on the light image area. That process is particularly useful as it is capable of exactly following the fluctuation of the potential in the light image area by conducting the measurement in each imaging cycle.

Figure 10:
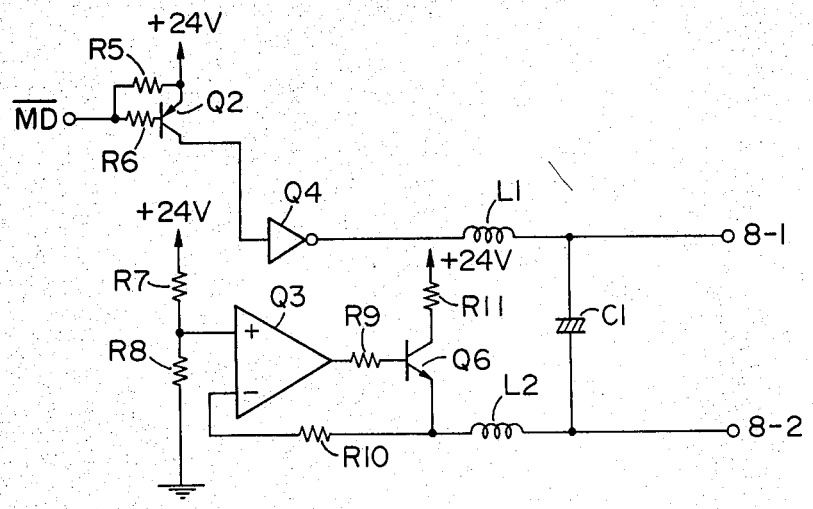
FIG. 10 is a schematic diagram showing circuitry for controlling the rotation of the sensor motor.
Figure 11:
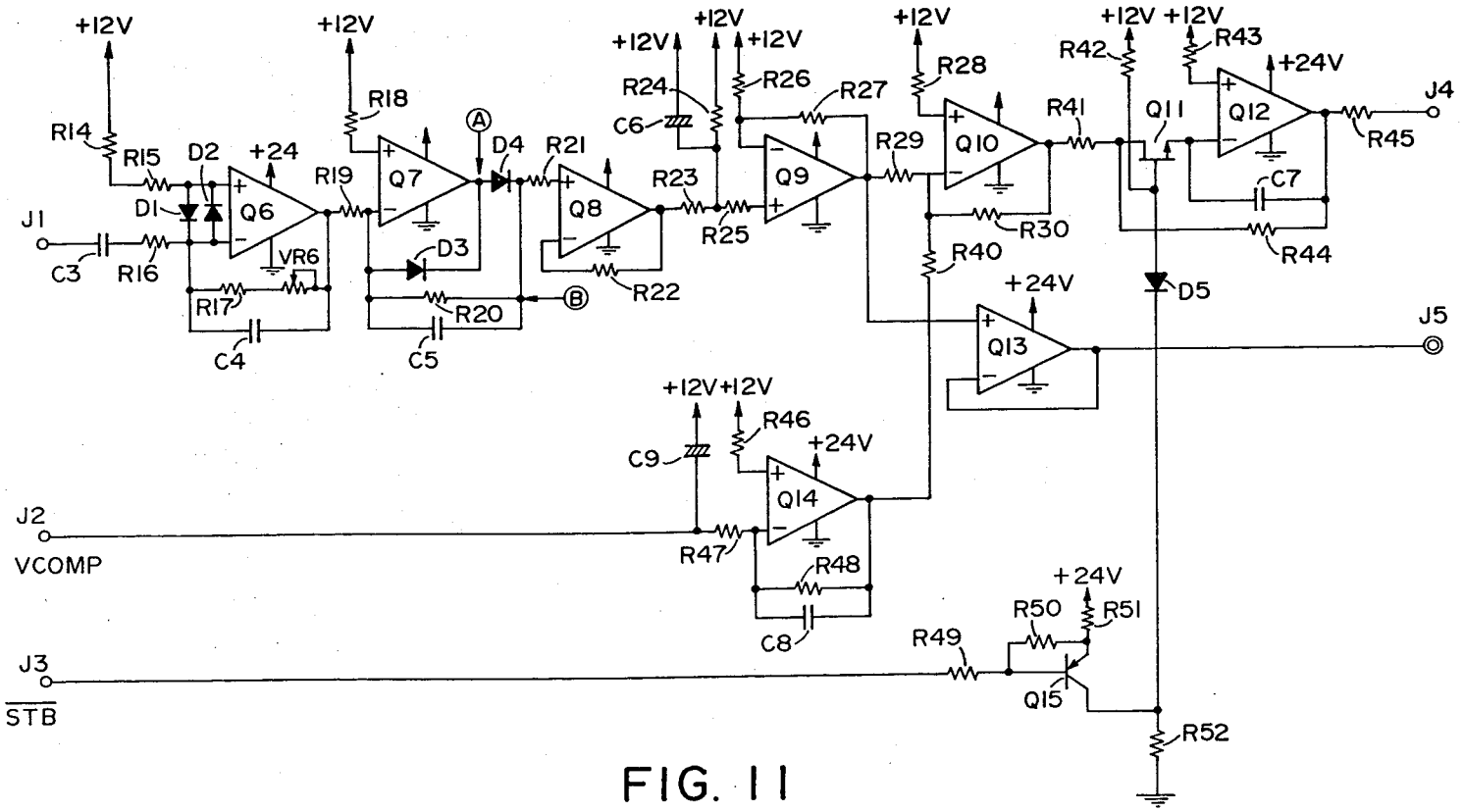
FIG. 11 is a schematic circuit diagram showing in detail the amplifying circuit 204, rectifying-smoothing circuit 205 and sample and hold circuit 206 shown in FIG. 6.

FIG. 10 shows the details of the sensor motor drive circuit 203 shown in FIG. 6, wherein, in response to a high level of main motor drive signal MD, an inverter connected to the open collector of transistor Q2 provides a low-level output whereby the voltage across capacitor C1, which is equal to the voltage supplied to the sensor motor, is determined by resistors R7, R8 in a voltage regulator circuit comprising an operational amplifier Q3 and a transistor Q6. FIG. 11 shows in detail the aforementioned AC amplifier 204, rectifying-smoothing circuit 205 and sample and hold circuit 206. The AC voltage detected by the sensor 50 is supplied from a terminal J1 to a coupling capacitor C3 and is amplified by an amplifier Q6 into an AC signal of a level centered at +12 volts. VR6 represents a variable resistor for controlling the detecting gain.

The rectifying circuit 205 is composed of an operational amplifier Q7, diodes D3, D4 and a resistor R20 to constitute a linear rectifying circuit for linearly amplifying the positive component only above +12 volts. In this circuit, when the input voltage to the inverted input terminal of the operational amplifier Q7 is positive with respect to that of the non-inverted input terminal, the junction A assumes a negative potential to turn the diode D4 off and turn the diode D3 on, whereby the inverted input terminal and the output at the junction B assume a potential of +12 volts. On the other hand, when the input voltage to the inverted input terminal is negative with respect to that of the non-inverted input terminal, the junction A assumes a positive potential to turn the diode D4 on and turn the diode D3 off, whereby the signal is linearly rectified and amplified with a gain equal a ratio of −R20/R19. The use of such a linear rectifying circuit improves the linearity of the DC signal with respect to the drum surface potential and also allows sufficient compensation for temperature variation.

Figure 12A:
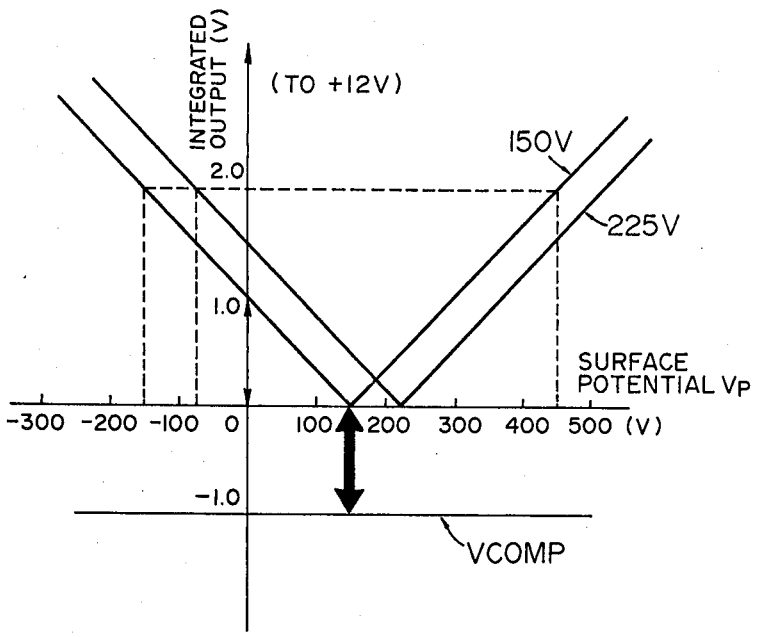
FIGS. 12A–12D are charts showing the relationships between the surface potential $V_p$ and various outputs of the circuits shown in FIG. 11.
Figure 12B:
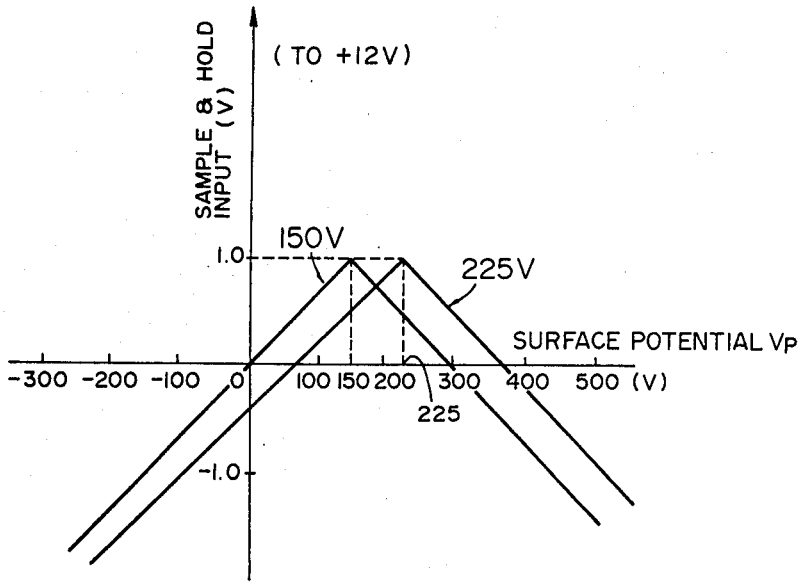

The rectified signal is transmitted through a buffer amplifier composed of an operational amplifier Q8, then smoothed by a smoothing capacitor C6 and further amplified by a buffer amplifier Q9, of which output signal is transferred through a voltage follower Q13 to a terminal J5 for voltage setting. As shown in FIG. 12A, the integrated output voltage at terminal J5 changes with a change of the drum surface potential symmetrically with respect to the sensor bias voltage $V_{BIAS}$. A sensor bias compensation signal $V_{COMP}$, which is divided with resistors from the sensor bias voltage $V_{BIAS}$ and is equal to +1 volt (standard +12 volts) in the present embodiment, is supplied from the developing bias control 207 to a terminal J2 through a line 71, and supplied to the inverted input terminal of an addition amplifier Q10 after polarity inversion in an operational amplifier Q14, thus with a value of −1 volt (standard +12 volts). The output of amplifier Q14 is shown in FIG. 12B. Consequently sensor bias compensation signal $V_{COMP}$ functions to obtain a rectified output of 0 volt or ground potential when the drum surface potential is 0 volt with respect to the sensor bias voltage, and to compensate for the fluctuation in the rectified output resulting from an eventual fluctuation in the sensor bias voltage $V_{BIAS}$. In this manner a stable measurement is assured since a voltage which is resistor-divided from the bias voltage applied to the casing of the potential sensor is added to the rectified output of the sensor to compensate for an eventual fluctuation in the bias voltage. Such a method is applicable not only to the cage-type potential sensor employed in the present embodiment but also to any potential sensor in which the measured potential is taken out as an AC signal and then rectified into a DC signal.

Figure 12C:
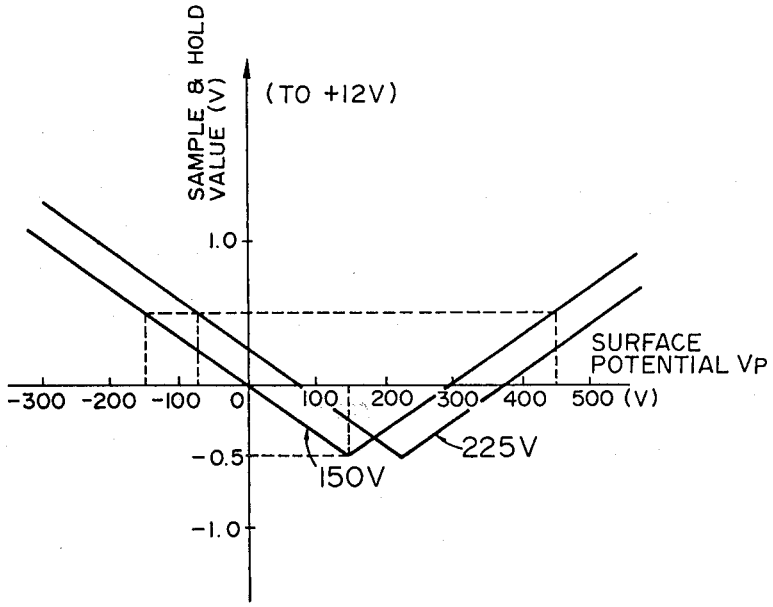
Figure 12D:
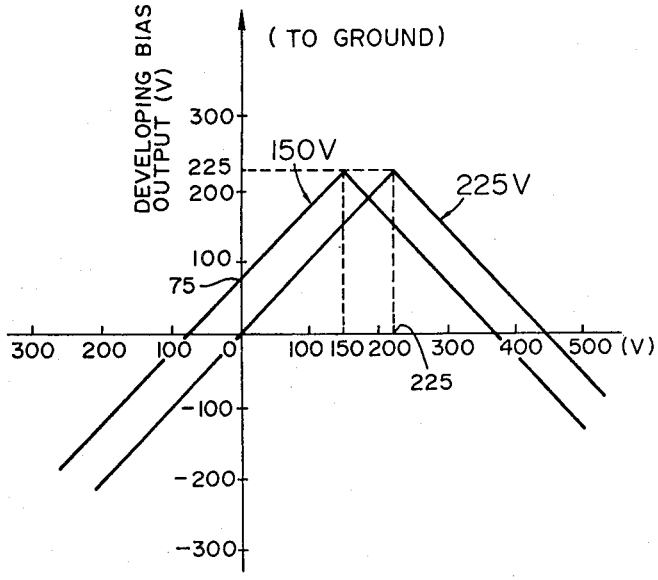
Figure 13:
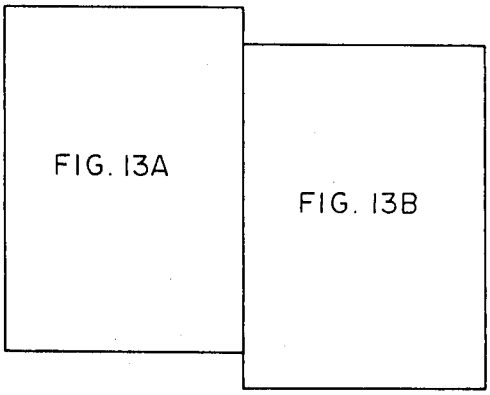
FIGS. 13A and 13B, when combined as shown in FIG. 13, are schematic circuit diagrams showing in detail the developing bias control circuit 207 shown in FIG. 6.
Figure 13A:
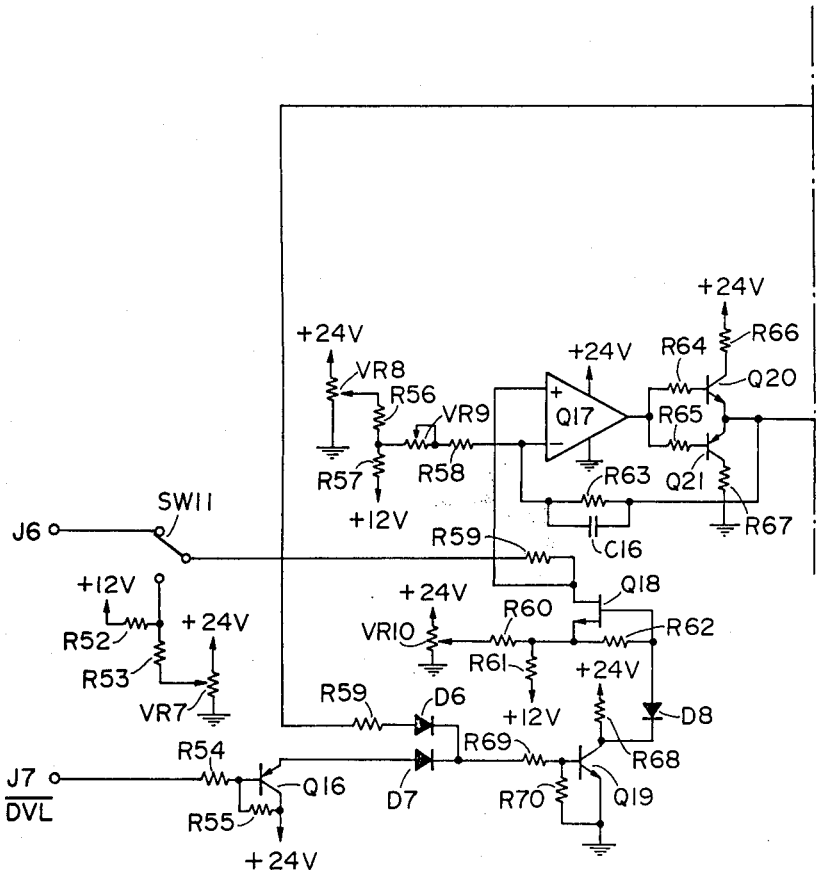
Figure 13B:
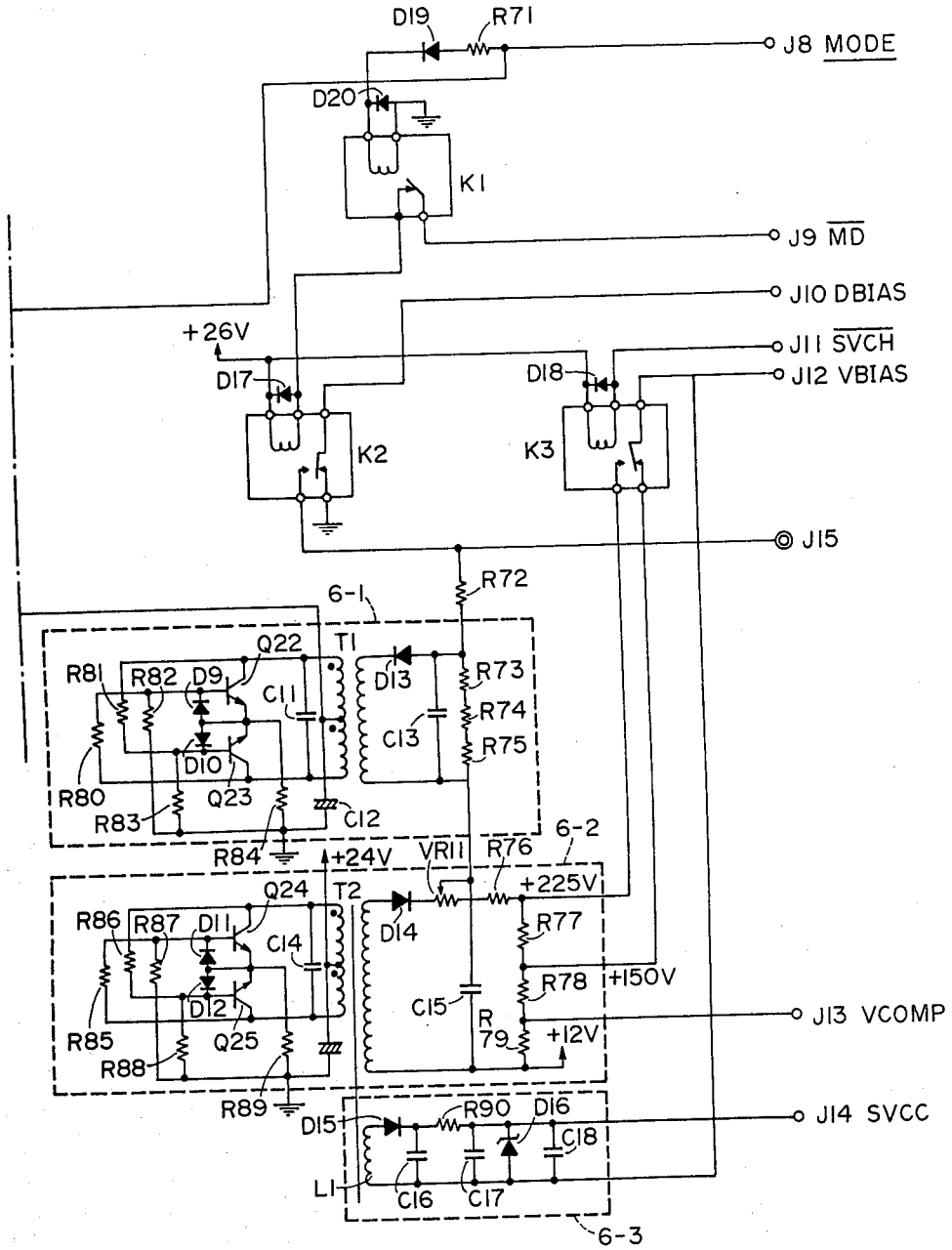

The output of addition amplifier Q10 is supplied to a sample and hold circuit composed of a junction-type field effect transistor Q11, an amplifier Q12, a low leakage capacitor C7 and a resistor R44. When the potential sensing signal $\overline{STB}$ received at a terminal J3 is at the high level, a transistor Q15 is turned off to apply an inverse bias equal to the voltage drop across a resistor R42 between the gate and source of transistor Q11. In this manner transistor Q11 is turned off, whereby the charge in the capacitor C7 remains constant, thus maintaining the output of the amplifier Q12 constant. On the other hand when signal $\overline{STB}$ is at the low level, the transistor Q15 is turned on to turn a diode D5 off, thus applying a zero bias between the gate and source of the transistor Q11. In this manner transistor Q11 is turned on, whereby the output of the amplifier Q10 charges the condenser C7, and the output of the amplifier Q12 becomes equal to a value of −(output of Q10)×R44/R41. When the signal STB again returns to its high level, the transistor Q11 is turned off to open a terminal of the capacitor C7, thereby maintaining the charge therein. In the above-explained manner the sample and hold circuit samples and holds the output of the amplifier Q10 when the signal STB is at the low level. FIG. 12C shows the relationship between the output of the operational amplifier Q12 and the drum surface potential, in case the sensor bias voltage $V_{BIAS}$ is 150 or 225 volts. That output signal is supplied, through a terminal J4 and a line 72 shown in FIG. 6, to the developing bias control 207, of which details are shown in FIGS. 13A and 13B. The blocks 6-1 and 6-2 are high-voltage generating circuits. In the block 6-2, either one of transistors Q24 and Q25 is turned on when the primary winding of an inverter transformer T2 receives a supply of +24 volts at the center tap thereof. For example if the transistor Q24 is turned on, the emitter current thereof increases with a gradient of 48/L, where L is the inductance of the primary winding and it is assumed that R85=R86>>R87=R88. The emitter current becomes saturated when the emitter voltage approaches a value of 48×R87/(R87+R85). At this point an inverse electromotive force is induced in the winding connected to the collector of the transistor Q25 thus turning the transistor Q24 off, whereupon a voltage of +48 volts is induced at the collector thereof to turn the transistor Q25 on. Thereafter the oscillation is maintained between the transistors Q24 and Q25 by the similar positive feedback. D11 and D12 designate diodes for protecting transistors Q24, Q25. The oscillating amplitude is approximately equal to twice as much as the voltage supplied to the transformer T2. The obtained voltage will be elevated to a voltage determined by the winding turn ratio of the transformer T2, then rectified and smoothed by a diode D14 and a capacitor C15 to obtain a high DC voltage. The circuit block 6-1 provides a high voltage in a similar manner, which however is variable according to the change of voltage supplied from an amplifier Q17 to a transformer T1. Operational amplifier Q17 receives, as the input signal thereto, the aforementioned sample and hold voltage or a voltage determined by a variable resistor VR10 according to the state of the developer drive signal $\overline{DVL}$. When said signal is at the high level, transistor Q16 and Q19 are turned off to apply a forward bias between the source electrode of a field effect transistor Q18 and the gate electrode thereof which assumes the same potential as that of the source through a resistor R62, thus turning transistor Q18 on. In this state, therefore, the operational amplifier Q17 receives, as the input signal, the voltage determined by the variable resistor VR10. On the other hand when signal $\overline{DVL}$ is at its low level, the sample and hold voltage supplied from a terminal J6 is utilized as the input signal to amplifier Q17. The signal supplied to amplifier Q17 is compared with an inverted input voltage determined by variable resistors VR8 and VR9, then amplified and supplied to the transformer T1 through a current booster composed of transistors Q20, Q21. A higher voltage supplied to transformer T1 increases the oscillating amplitude, thus generating a higher negative voltage at the secondary winding thereof. This output voltage is added to the fixed positive output voltage of the block 6-2 and supplied, as the developing bias voltage, to the developing unit through a relay K2. FIG. 12D shows the relationship between the developing bias voltage $D_{BIAS}$ and the drum surface potential when the sample and hold voltage is supplied to the amplifier Q17. The resistors VR8 and VR9 respectively regulate the crossing point with the Y-axis and the slope of the line in FIG. 12D. As will be apparent from this chart, the developing bias voltage for a drum potential of the light image area not exceeding 150 volts can be represented as follows:

$$D_{BIAS}=Vp+75 \text{ volts}$$

Consequently the electric field between the light image area and the developing unit is constantly directly from the drum to the developing unit, thus avoiding the fog formation by the deposition of toner particles on the light image area.

A signal MODE supplied to a terminal J8 assumes the high level state at the potential setting operation to be explained later to select the sample and hold voltage from the terminal J6 as the input signal to the amplifier Q17 and to open the contact of relay K1, thus preventing the developing bias voltage $D_{BIAS}$ from being supplied to the developing unit. When the main motor non-drive signal $\overline{MD}$ received at a terminal J9 assumes its low level state, the relay K2 is energized to apply the developing bias voltage $D_{BIAS}$ to the developing unit 25. At this potential setting operation, a sensor bias switching signal $\overline{SVCH}$ is switched between the high and low level states to select either a voltage 225 volts across resistors R76 and R77 or a voltage 150 volts across resistors R77 and R78 as the sensor bias voltage $V_{BIAS}$. During the normal copying operating signal $\overline{SVCH}$ assumes the high level state to supply 150 volts as the sensor bias voltage. The sensor power supply $SV_{cc}$ is constantly maintained at 24 volts regardless of the sensor bias $V_{BIAS}$ as the supply is obtained from an independent winding L1 of the transformer T2 and overlapped to the sensor bias after rectifying and smoothing by a diode D15, capacitors C16, C17, C18 and a resistor R9.

Also in the present embodiment, as shown in the time chart in FIG. 15, the amount of light from the blank exposure lamp 10 represented by a signal BEXP is regulated to a predetermined value during the potential measurement but is changed to a larger value after the completion of image recording. More specifically the amount of light is adjusted to a value within a dynamic range wherein the surface potential changes in response to the amount of light during the measurement of surface potential, but this amount is changed, after the completion of image recording, to a value large enough to remove the uneven electric field resulting from the carriers generated in the photosensitive layer. The above-explained function can be easily achieved by a circuit shown in FIG. 16, wherein BEXP designates the blank exposure lamp signal and LSTR a post-rotation signal. During the imaging cycle transistors Tr1, Tr2 remain turned off, as signal LSTR is in the low level. Thus, when the signal BEXP assumes its high level state, a transistor Tr3 is turned on to apply a voltage to the blank exposure lamp 10 through a variable resistor VR3, thereby lighting the lamp with an adjusted intensity to be determined by variable resistor VR3. When the post-rotation signal LSTR assumes its high level upon completion of the image recording, the transistors Tr1, Tr2 are turned on to supply that voltage (24 volts) directly to the blank exposure lamp, thereby obtaining a higher intensity of light.

Now there will be given an explanation on mode switches for drum potential setting, while making reference to FIG. 6 and following Table 1.

TABLE 1

| Mode switches | Loads to be driven | Target drum potential | Sensor bias | Difference | Potential to be set | Items to be adjusted |
|---|---|---|---|---|---|---|
| SW1 | Main motor, Pre-exposure lamp, High-voltage transformer, Whole surface exposure lamp, Sensor motor, Sensor | +450 V | +150 V | 300 V | Dark potential $V_D$ | Wire of primary charger |
| SW2 | Main motor, Pre-exposure lamp, High-voltage transformer, Strong blank exposure lamp, Whole surface exposure lamp, Sensor motor, Sensor | −150 V | +150 V | 300 V | Light saturation potential $V_{SL}$ by strong blank | Output of AC charge eliminator |
| SW3 | Main motor, Pre-exposure lamp, High-voltage transformer, Weak blank exposure lamp, Whole surface exposure lamp, Sensor motor, Sensor | −75 V | +225 V | 300 V | Light potential $V_L$ by weak blank | Intensity of blank |
| SW4 | Main motor, Pre-exposure lamp, High-voltage transformer, Exposure lamp, Whole surface exposure lamp, Sensor motor, Sensor | −75 V | +225 V | 300 V | Potential $V_{IMAGE}$ for standard white original illuminated with exposure lamp | Exposure lamp |
| SW5 | Optical system forward clutch | Enable copying cycle with the copy button | | | | |
| SW6 | Reset | | | | | |

In order to adjust the drum to its appropriate state at the time of machine assembling or drum exchanging, it is necessary to suitably set the dark potential $V_D$, light saturation potential $V_{SL}$, light potential $V_{IMAGE}$ corresponding to the standard white original, and, in the case of controlling the developing bias, the light potential $V_L$ corresponding to the weak blank exposure, as shown in Table 1. The mode switches shown in FIG. 6 allow selection of the driving conditions for generating a particular set potential in response to the actuation of a selected mode switch.

The mode switch SW1 turns off the blank exposure lamp and is therefore utilized adjust the dark potential $V_D$ corresponding to a dark image area of the original to a target potential of +450 volts. The adjustment can be achieved by regulating the wire of the primary charger, while watching the output of the potential sensor.

The mode switch SW2 turns on the blank exposure lamp at the strong intensity and is therefore utilized for adjusting the light saturation potential $V_{SL}$ of the drum to a target potential of −150 volts. The adjustment can be achieved by regulating the output of the AC charge eliminator while watching the output of the potential sensor.

The mode switch SW3 turns on the blank exposure lamp at a weaker intensity and is therefore utilized for adjusting the light potential $V_L$ of the drum corresponding to a light image area to a target potential of −75 volts. The adjustment can be achieved by regulating the variable resistor VR3 for intensity control of the blank exposure lamp, while watching the output of the potential sensor.

The mode switch SW4 is utilized for adjusting the intensity of the exposure lamp, by means of a variable resistor VR4, in such a manner that the light potential $V_{IMAGE}$ obtained by the light of the exposure lamp reflected by a standard white original with the exposure dial placed at its middle position coincides with the above-mentioned light potential $V_L$ adjusted with the mode switch SW3. Prior to the actuation of the mode switch SW4, a standard white original is placed on the original supporting plate of glass 14, then the exposure dial is placed at its middle position, and the mode switch SW5 is actuated to energize the optical system forward clutch thereby advancing the optical system composed of the exposure lamp and the mirror to a position where the original is illuminated by the exposure lamp. Thereafter the mode switch SW4 is actuated, and potential $V_{IMAGE}$ is adjusted to light potential $V_L$ by regulating the resistor VR4 while watching the output of the potential sensor. In this manner the intensity of the light of the exposure lamp reflected by the standard white original with the exposure control dial placed at its middle position is adjusted to a level equal to the weak light intensity of the blank exposure lamp for developing bias control, thereby assuring a precise control of the developing bias. In the present embodiment the mode switch SW5 is provided as a separate switch, but it is also possible to design the circuit so as to drive the optical system forward clutch upon actuation of the mode switch SW4. In addition the CPU 201 shown in FIG. 6 changes the sensor bias voltage $V_{bias}$ according to the selected mode in such a manner that the difference between the target drum potential and the sensor bias voltage is always constant, as shown in Table 1. The serviceman can therefore perform various potential adjustments utilizing a single value, without the need of memorizing different values for setting different potentials.

FIGS. 17*A* to 17*D* respectively show the functions of the apparatus when the mode switches SW1, SW2, SW3 and SW4 are actuated, respectively. For example, upon actuation of the mode switch SW1, the CPU 201 produces, through drivers DR, the main motor drive signal MD, high-voltage transformer signal HV1 for the primary charger, and high-voltage transformer signal HV2 for the AC charge eliminator. Signal MD is also supplied to the sensor motor drive 203 and the developing bias control 207 through lines 76, 75 to drive the sensor motor, whereby the potential detection signal is supplied through the AC amplifier 204, rectifying-smoothing circuit 205, sample and hold circuit 206 to the developing bias control 207. The signal STB assumes the high level at this point (low level for $\overline{STB}$) to turn on an analog switch transistor Q11 (FIG. 11) in the sample and hold circuit 206. The sensor bias switching signal SVCH being at its high level (low level for $\overline{SVCH}$), the relay K3 shown in FIG. 13 is switched so as to supply a voltage of 150 volts as the sensor bias $V_{BIAS}$ to the casing, chopper and internal circuitry of the potential sensor. As the signal MODE indicating if any of the mode switches is actuated is in its high level state, the transistor Q19 and relay K1 in FIG. 13 are turned on whereby the operational amplifier Q17 selects the signal from the terminal J6 as the input signal while the developing unit is cut out from the developing bias $D_{BIAS}$. In this state the drum 11 is maintained in rotation and the primary charger 22, AC charge eliminator 23 and whole surface exposure lamp 24 are turned on, but the other exposure lamps are not lighted, so that the drum surface potential measured by the potential sensor 50 is the dark potential $V_D$ corresponding to a dark image area of the original. In this state the check terminal J5 provides an output as shown in FIG. 12A. A target dark potential of 450 volts can therefore be obtained by adjusting the variable resistor VR1 for the wire of the primary charger so as to obtain an output of 2 volts at check terminal J5. In a similar manner the mode switch 2, 3 or 4 realizes a predetermined load drive condition wherein the drum surface potential detected by the potential sensor 50 respectively corresponds to the aforementioned light saturation potential $V_{SL}$, light potential $V_L$ or potential $V_{IMAGE}$. In using these mode switches, the adjustment can be performed in the same manner so as to obtain an output voltage of 2 volts from the check terminal J5 despite the fact that the target potential is different for each mode, since the sensor bias voltage $V_{BIAS}$ is automatically changed according to the selected mode. In the presence of mode switch 202, the potential sensor 50 functions not only control the developing bias for reducing the fog effect but also as an incorporated potential sensor for various potential settings. Also it is advantageous in that the serviceman can perform the potential adjustments utilizing only one value, without the need for memorizing different values for different adjustments.

Further, it is possible to display the detected output of the surface potential in plural levels by means of a comparing circuit as shown in FIG. 14.

In this circuit, comparators COM1–COM5 receive, at the non-inverted input terminals thereof, the DC output voltage from the surface potential detecting circuit, and, at the inverted input terminals thereof, the standard voltages V1–V5 which are selected to satisfy the following relationship: $V1>V2>V3>V4>V5$. The desired adjustments can be performed by regulating the variable resistors VR1–VR4 in such a manner that the light-emitting diode LED3 alone becomes energized. In this manner it is rendered possible to adjust different surface potentials utilizing the same light-emitting diode as the index. Also the aforementioned mode switches allow one to selectively drive only a part of the plural processing means for the image formation. Such instruction devices, therefore, render it possible to closely inspect the operative functions of a part of the apparatus without driving the entire apparatus. Furthermore, the measurement of various potentials on the drum (for example dark potential or light potential) by the surface potential sensor, is significantly facilitated as the loads can be selectively driven according to the desired mode.

It will be understood that the present invention is by no means limited to the embodiment explained in the foregoing but may comprise any other modifications and applications within the scope of the appended claims.

What we claim is:

1. Image forming apparatus, comprising:

detecting means for detecting surface potential of a recording member;

a plurality of processing means for forming an electrostatic latent image on said recording member; and a plurality of adjusting means for adjusting said processing means so as to set the surface potential which is formed on said recording member in different operation modes, to respectively different target values; said detecting means being adapted to provide approximately the same detection output with respect to said different target values.

2. Image forming apparatus according to claim 1, wherein said detecting means comprises a detecting electrode and shielding means for shielding said detecting electrode from said recording member.

3. Image forming apparatus according to claim 2, further comprising bias applying means for applying a bias voltage to said shielding means such that difference between said different target potentials and said bias voltage is kept constant.

4. Image forming apparatus according to claim 1, wherein one of said processing means comprises charging means for uniformly charging said recording member.

5. Image forming apparatus according to claim 4, wherein said adjusting means comprises a charging adjustment member for adjusting output from said charging means.

6. Image forming apparatus according to claim 5, wherein said recording member comprises a photosensitive member, said apparatus further comprising exposure means for projecting light onto said photosensitive member after charging by said charging means.

7. Image forming apparatus according to claim 6, wherein one of said operation modes is a mode for projecting light onto said photosensitive member by said exposure means, another being a mode not projecting light onto said photosensitive member.

8. Image forming apparatus according to claim 7, wherein said charging adjustment member is adjusted in said mode not projecting light onto said photosensitive member.

9. Image forming apparatus according to claim 7, wherein said adjusting means further comprises a light amount adjusting member for adjusting an amount of light from said exposure means.

10. Image forming apparatus according to claim 9, wherein said light amount adjusting member is adjusted in said mode for projecting light onto said photosensitive member.

11. Image forming apparatus according to claim 1, further comprising control means for selectively driving said processing means according to said operation modes.

12. Image forming apparatus according to claim 1, further comprising display means for displaying, in distinct levels, the detection output from said detecting means.

13. Image forming apparatus comprising:

operative means, including a plurality of operable parts, for forming an image on a recording member;

instruction means for selectively instructing the performance of first and second different tests on operative functions of the image forming means; and control means for controlling the operation of said operable parts in the performance of said tests under instruction by said instruction means, such that a particular one of said operable parts is caused to operate in both the first and second tests, but in different respective operational states.

14. Image forming apparatus according to claim 13 wherein said instruction means comprises first and second means for producing respective first and second instructions for the performance of the respective first and second tests.

15. Image forming apparatus according to claim 14 wherein said first and second means comprise respective independently operable switches.

16. Image forming apparatus according to either one of claims 13 and 14, wherein said control means is arranged to cause the operation in said first and second tests of a combination of operable parts.

17. Image forming apparatus according to claim 16 wherein said combination of operable parts comprises an illuminating means and an electrical charging means.

18. Image forming apparatus according to claim 17 wherein said image forming means comprises a first lamp means for illuminating an original of which an image is to be formed on the recording medium, and said illuminating means comprises a second lamp means for uniformly exposing the recording member to illuminating light.

19. Image forming apparatus according to claim 17 or claim 18 wherein said combination of operable parts also includes means for detecting a surface condition of the recording member.

20. Image forming apparatus according to claim 19 wherein said surface condition is the electrical potential at the surface of said recording member.

21. Image forming apparatus according to claim 18 wherein said particular one of said operable parts comprises said second lamp means.

22. Image forming apparatus according to claim 21 wherein said second lamp means produces a relatively high and a relatively low light output, respectively, in said first and second operation of states thereof.

* * * * *